US007559442B1

(12) United States Patent
Plummer

(10) Patent No.: US 7,559,442 B1
(45) Date of Patent: Jul. 14, 2009

(54) LAUNDRY SOAP DISPENSING APPARATUS

(76) Inventor: Angelina R. Plummer, P.O. Box 2285, Fallon, NV (US) 89407

( * ) Notice: Subject to any disclaimer, the term of this patent is extended or adjusted under 35 U.S.C. 154(b) by 588 days.

(21) Appl. No.: 11/318,011

(22) Filed: Dec. 27, 2005

(51) Int. Cl.
*B65D 88/54* (2006.01)

(52) U.S. Cl. ..... 222/288; 222/292; 222/305; 141/358; 141/362

(58) Field of Classification Search ..... 222/142, 222/287–288, 292, 283–284, 305, 359, 362–364, 222/368; 141/354, 358, 368
See application file for complete search history.

(56) References Cited

U.S. PATENT DOCUMENTS 1,053,169 A * 2/1913 Gillespie ..... 222/304
2,025,821 A * 12/1935 Nordmarken ..... 222/368
2,072,760 A * 3/1937 Ludwig ..... 222/189.02
2,116,300 A * 5/1938 Campos ..... 141/369
2,504,740 A * 4/1950 Siegel ..... 222/192
2,575,967 A * 11/1951 May ..... 222/39
2,648,477 A * 8/1953 Harrington ..... 141/98
2,793,940 A * 5/1957 Bennett ..... 422/261
2,799,432 A * 7/1957 Suppiger et al. ..... 222/139
2,853,172 A * 9/1958 Angell ..... 194/350
2,920,796 A * 1/1960 Field ..... 222/185.1
3,204,833 A * 9/1965 Weitzner ..... 222/355
3,463,360 A * 8/1969 Dorfman ..... 222/139
3,578,209 A * 5/1971 Fraser ..... 222/23
3,595,092 A * 7/1971 Mayer et al. ..... 74/10.27
3,791,556 A * 2/1974 Tarter ..... 222/21
3,850,347 A * 11/1974 Hill ..... 222/368
3,889,854 A * 6/1975 Gagnon et al. ..... 222/284
3,901,097 A * 8/1975 Williams et al. ..... 74/473.3
3,952,925 A * 4/1976 Babunovic et al. ..... 222/485
4,149,656 A * 4/1979 Nelson ..... 222/652
4,158,374 A * 6/1979 Ciuffetti ..... 141/392
4,162,751 A * 7/1979 Hetland et al. ..... 222/293
4,232,718 A * 11/1980 Wippermann ..... 141/358
4,266,695 A * 5/1981 Ruperez ..... 222/185.1
4,314,657 A 2/1982 Perakis et al.
4,448,331 A * 5/1984 Millette et al. ..... 222/185.1
4,503,995 A * 3/1985 Anderson ..... 222/219
4,569,463 A * 2/1986 Pellegrino ..... 222/288
4,635,829 A * 1/1987 Brittingham, Jr. ..... 222/278
4,860,930 A * 8/1989 Tu ..... 222/231
RE33,083 E * 10/1989 Pellegrino ..... 222/288
5,085,346 A * 2/1992 Wright ..... 222/143
5,236,022 A * 8/1993 Husted ..... 141/358
5,375,744 A * 12/1994 Henderson ..... 222/306
5,437,393 A * 8/1995 Blicher et al. ..... 222/77
5,529,219 A * 6/1996 Ward ..... 222/156

(Continued)

*Primary Examiner*—Kevin P Shaver
*Assistant Examiner*—Andrew P Bainbridge

(57) ABSTRACT

A laundry soap dispensing apparatus includes a housing that has a back wall, a bottom wall, a front wall, a first side wall and a second side wall. The front wall has a cup opening therein positioned adjacent to the bottom wall and configured for receiving a cup. A trough is mounted within the housing and has a pour opening therein directed toward the bottom wall and a cup extended through the cup opening. Soap poured into the housing is directed into the trough and toward the pour opening. A measuring assembly is mounted in the housing and is in fluid communication with the pour opening. The measuring assembly is configured to dispense one of a plurality of selectable amounts of laundry soap into the cup. Laundry soap positioned within the trough may be poured into the cup by actuating the measuring assembly.

7 Claims, 5 Drawing Sheets

U.S. PATENT DOCUMENTS 5,642,762 A * 7/1997 Greenberg et al. ..... 141/358
5,810,206 A * 9/1998 Bruggendick et al. .... 222/145.5
5,833,097 A * 11/1998 Ruth ..... 222/368
5,899,248 A * 5/1999 Anderson ..... 141/358
5,901,886 A * 5/1999 Grindstaff et al. ..... 222/557
5,908,144 A * 6/1999 Dalton ..... 222/185.1
5,927,558 A * 7/1999 Bruce ..... 222/185.1
D413,767 S * 9/1999 Elmore ..... D7/589
6,293,440 B1 * 9/2001 Weaver ..... 222/368
6,546,969 B1 * 4/2003 Kelley, II ..... 141/18
6,701,974 B2 * 3/2004 Rudesill ..... 141/18
6,951,294 B1 * 10/2005 Laberinto ..... 222/142
6,964,355 B2 * 11/2005 Landau ..... 222/185.1
2006/0249531 A1 * 11/2006 Litchfield ..... 222/52

* cited by examiner

LAUNDRY SOAP DISPENSING APPARATUS

BACKGROUND OF THE INVENTION

1. Field of the Invention

The present invention relates to soap dispensing devices and more particularly pertains to a new soap dispensing device for storing and measuring out selectable amounts of laundry soap.

2. Description of the Prior Art

The use of soap dispensing devices is known in the prior art. While these devices fulfill their respective, particular objectives and requirements, the need remains for a device that allows a person to store laundry soap within a container that also includes means for pouring out selected amounts of the laundry soap to ensure that the user only receives the amount of laundry soap needed.

SUMMARY OF THE INVENTION

The present invention meets the needs presented above by generally comprising a housing that has a back wall, a bottom wall, a front wall, a first side wall and a second side wall. A cover is hingedly coupled to the back wall for selectively opening or closing an access opening defined by a top side of the housing. The front wall has a cup opening therein positioned adjacent to the bottom wall and configured for receiving a cup. A trough is mounted within the housing and has an upper end extending across the access opening. The trough has a pour opening therein directed toward the bottom wall and a cup extended through the cup opening. Any laundry soap poured into the access opening is directed into the trough and toward the pour opening. A measuring assembly is mounted in the housing and is in fluid communication with the pour opening. The measuring assembly is configured to dispense one of a plurality of selectable amounts of laundry soap into the cup. Laundry soap positioned within the trough may be poured into the cup by actuating the measuring assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
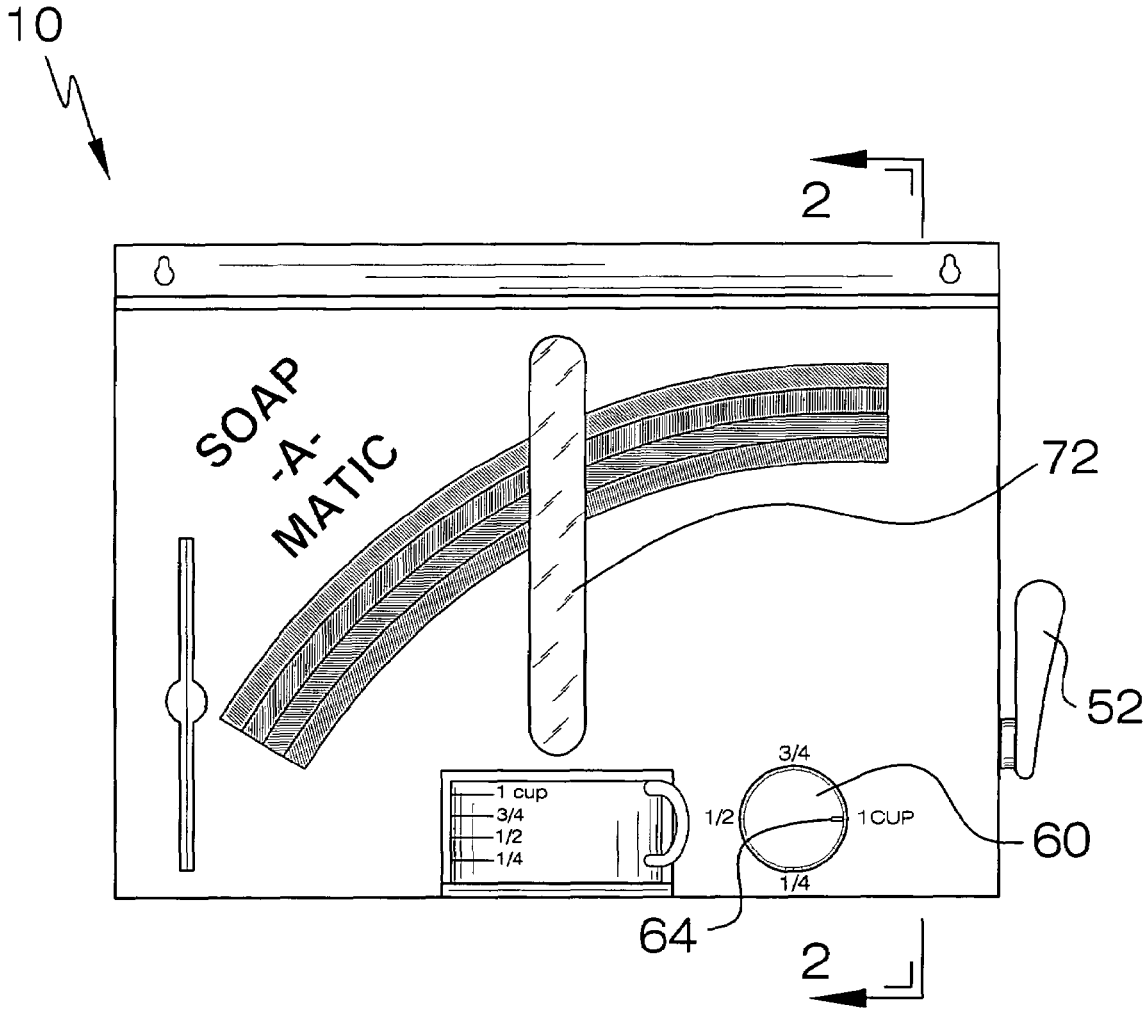
FIG. 1 is a front view of a laundry soap dispensing apparatus according to the present invention.
Figure 2:
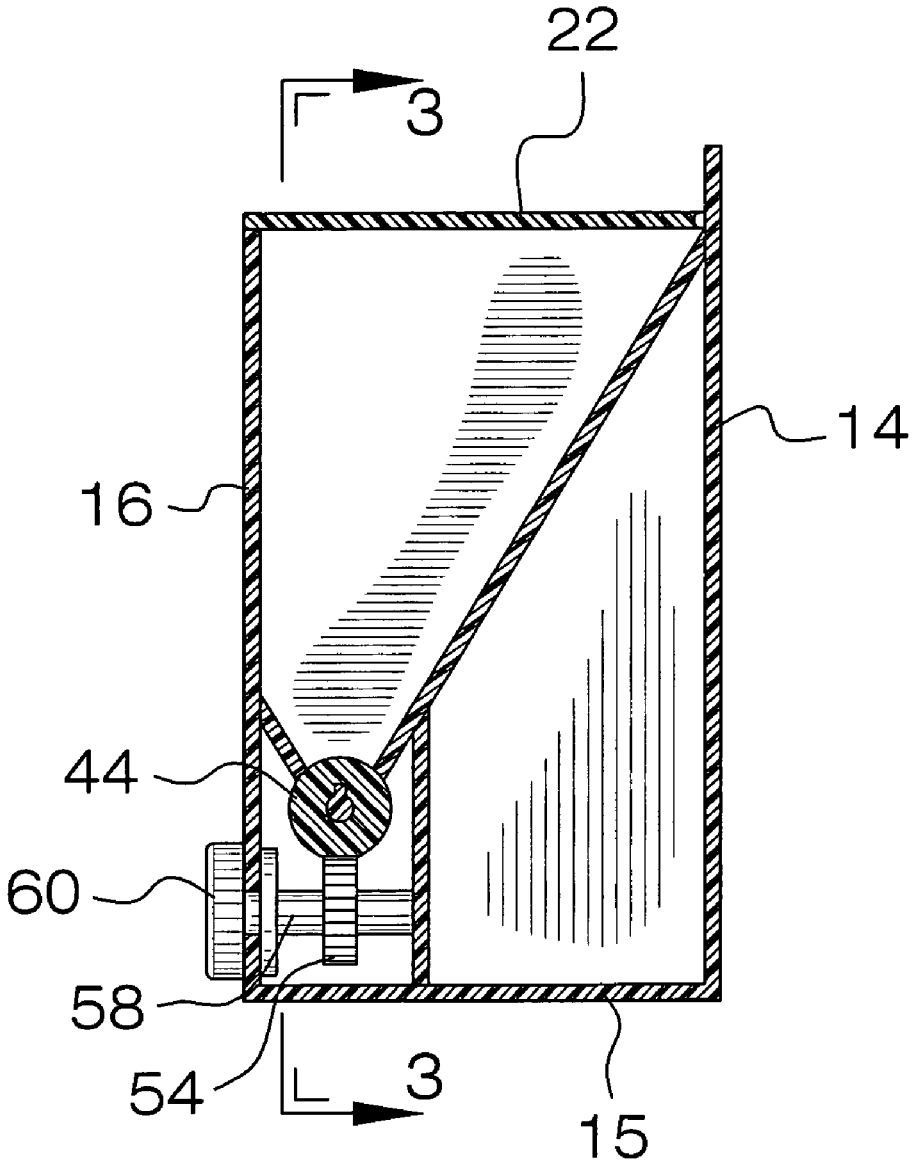
FIG. 2 is a cross-sectional view taken along line 2-2 of the present invention.
Figure 3:
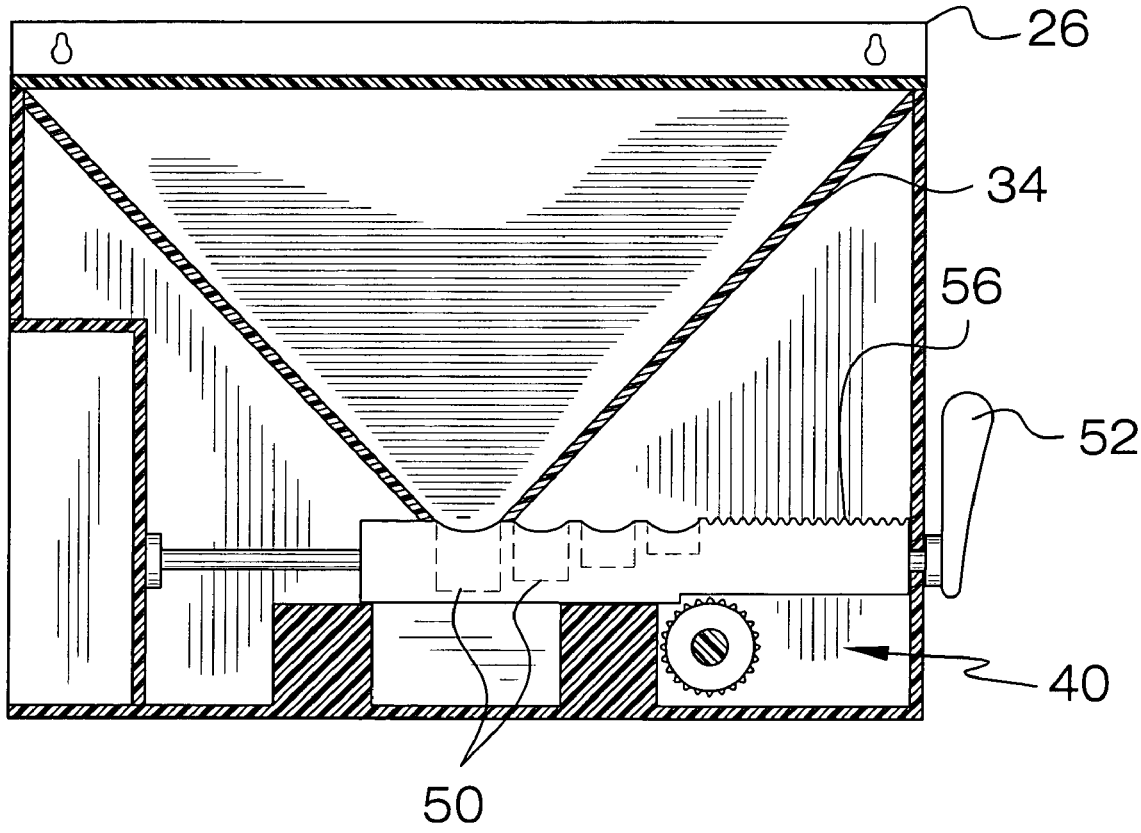
FIG. 3 is a cross-sectional view taken along line 3-3 of FIG. 2 of the present invention.
Figure 4:
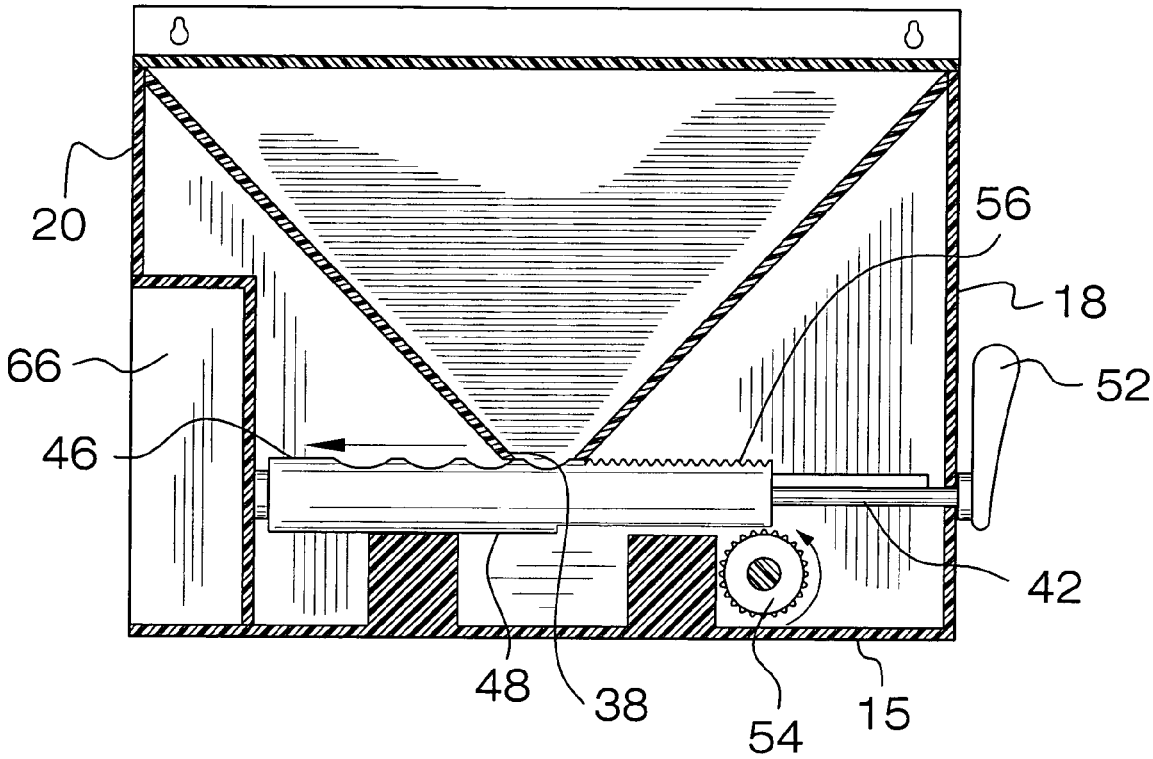
FIG. 4 is a cross-sectional view of the present invention.
Figure 5:
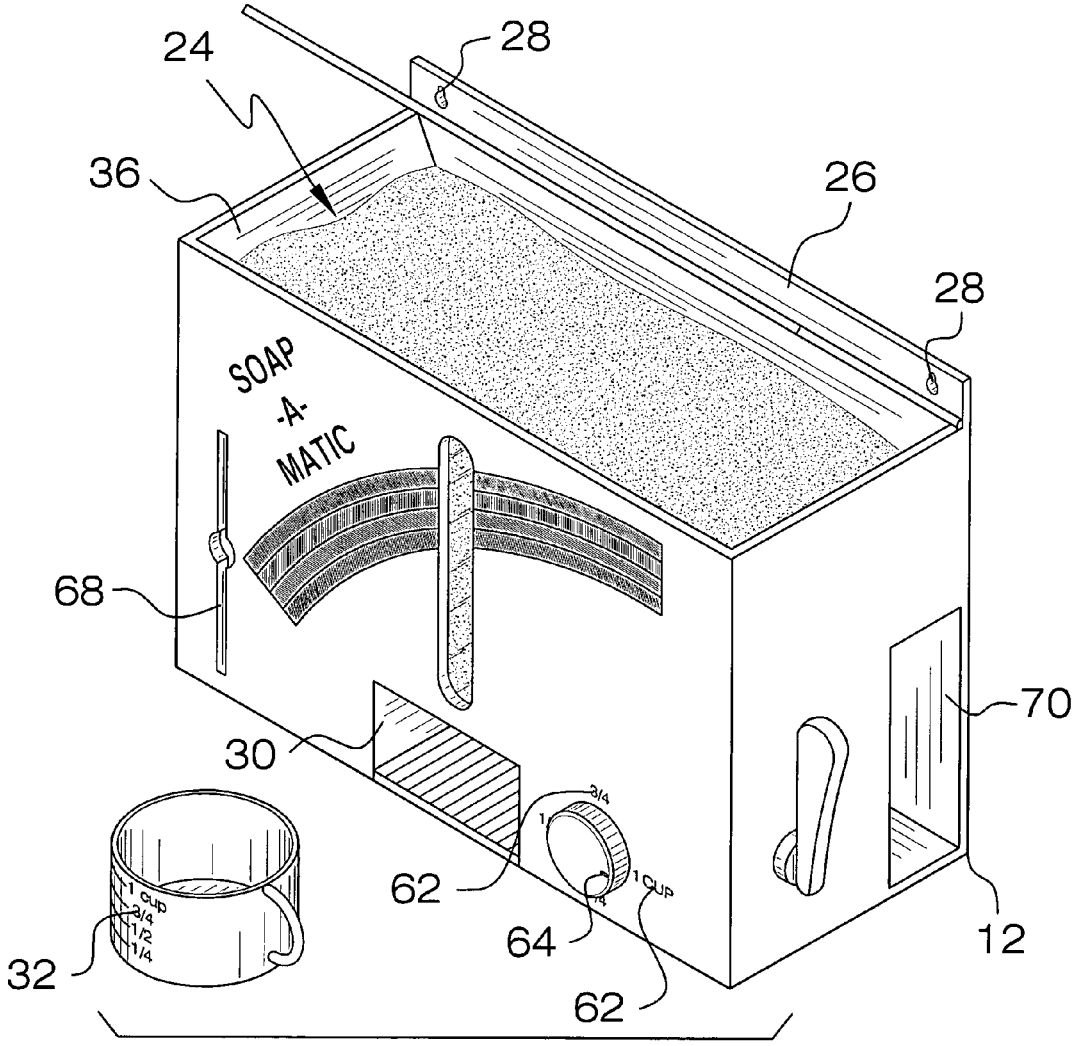
FIG. 5 is a perspective front view of the present invention.

With reference now to the drawings, and in particular to FIGS. 1 through 5 thereof, a new soap dispending device embodying the principles and concepts of the present invention and generally designated by the reference numeral 10 will be described.

As best illustrated in FIGS. 1 through 5, the laundry soap dispensing apparatus 10 generally comprises a housing 12 that has a back wall 14, a bottom wall 15, a front wall 16, a first side wall 18 and a second side wall 20. A cover 22 is hingedly coupled to the back wall 14 for selectively opening or closing an access opening 24 defined by a top side of the housing 12. A lip 26 extends upwardly from the back wall 14. The lip 26 has a plurality of apertures 28 extending therethrough configured for receiving a fastener so that the housing can be mounted on a wall surface. The front wall 16 has a cup opening 30 therein positioned adjacent to the bottom wall 15 and configured for receiving a cup 32.

A trough 34 is mounted within the housing 12. The trough 34 has an upper end 36 extending across the access opening 24. The trough 34 has a pour opening 38 therein directed toward the bottom wall 15 and the cup 32 extended through the cup opening 30. Any laundry soap poured into the access opening 24 is directed into the trough 34 and toward the pour opening 38. The trough 34 has angled walls angling toward the pour opening 38.

A measuring assembly 40 is mounted in the housing 12 and is in fluid communication with the pour opening 38. The measuring assembly 40 is configured to dispense one of a plurality of selectable amounts of Laundry soap into the cup 32. The selectable amounts preferably consist of 1 cup, ¾ cup, ½ cup and ¼ cup. Laundry soap positioned within the trough 34 may be poured into the cup 32 by actuating the measuring assembly.

The measuring assembly 40 includes a shaft 42 that is rotatably mounted in the housing 12 and extends outwardly of the first side wall 18. The shaft 42 is positioned between the pour opening 38 and the cup opening 30. An elongated member 44 is slidably mounted on the shaft 42 and has a longitudinal axis orientated perpendicular to the first side wall 18 and parallel to the shaft 42. The elongated member 44 has a top side 46 and a bottom side 48. The top side 46 has a plurality of wells 50 extending therein that are aligned with each other along a line orientated parallel to the longitudinal axis. Each of the wells 50 has a volume corresponding to one of the selectable amounts. A lever 52 is attached to the shaft 42 and positioned outside of the housing 12. The lever 52 is selectively positionable in a first position rotating the elongated member 44 so that the wells 50 are directed toward the pour opening 38 or in a second position rotating the elongated member 44 so that the wells 50 are directed toward the bottom wall 15.

The measuring assembly 40 further includes a gear 54 rotatably mounted in the housing 12 and having a rotational axis oriented perpendicular to the longitudinal axis. The gear 54 is in communication with teeth 56 on the top side 46 of the elongated member 44 when the lever 52 is in the second position. The elongated member 44 is slidably moved along the shaft 42 when the gear 54 is rotated and is engaging the teeth 56. A rod 58 is attached to the gear 54 and extends through the front wall 16. A handle 60 is attached to a distal end of the rod 58 with respect to the gear 54. A plurality of measurement indicia 62 is positioned on the front wall 16 adjacent to the handle 60 and each corresponds to one of the selectable amounts. An indicator marking 64 is positioned on the handle 60. One of the wells 50 is aligned with the pour opening 38 when the indicator marking 64 indicates one of the measurement indicia 62 associated with the well 50.

A softener sheet compartment 66 extends into the second side wall 20. The front wall 16 has an elongated slot 68 therein extending into the softener sheet compartment 66. Softener sheets positioned in the softener sheet compartment 66 are selectively removed from the softener sheet compartment through the slot 68. A container compartment 70 extends into the first side wall 18 and is positioned adjacent to the back wall 14. The container compartment 70 may be used for holding bleach, liquid soap, liquid softener or other related items. The front wall 16 includes a window 72 for verifying the amount of laundry soap positioned within the housing 12.

In use, the apparatus 10 is filled with dry laundry soap and then is used to fill a cup 32 with a selected amount of the laundry soap. The handle 60 and the measurement indicia 62 ensure that a user of the apparatus 10 will receive the correct quantity of laundry soap needed. The user retains the lever 52 in the second position, moves or rotates the handle 60 to the desired amount, then turns the lever 52 to the first position to fill the selected well 50 with soap. The user then turns the lever 52 back to the second position to pour the soap out of the selected well 50 and into the cup 32.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A laundry soap dispensing apparatus for storing and dispensing selected quantities of laundry soap, said apparatus comprising:

a housing having a back wall, a bottom wall, a front wall, a first side wall and a second side wall, a cover being hingedly coupled to said back wall for selectively opening or closing an access opening defined by a top side of said housing, said front wall having a cup opening therein positioned adjacent to said bottom wall and configured for receiving a cup;

a trough being mounted within said housing, said trough having an upper end extending across said access opening, said trough having a pour opening therein directed toward said bottom wall and a cup extended through said cup opening, wherein any laundry soap poured into said access opening is directed into said trough and toward the pour opening; and a measuring assembly being mounted in said housing and being in fluid communication with said pour opening, said measuring assembly being configured to dispense one of a plurality of selectable amounts of laundry soap into the cup, wherein laundry soap positioned within said trough may be poured into the cup by actuating said measuring assembly, said measuring assembly including:

a shaft being rotatably mounted in said housing and extending outwardly of said first side wall, said shaft being positioned between said pour opening and said cup opening;

an elongated member being slidably mounted on said shaft and having a longitudinal axis orientated perpendicular to said first side wall and parallel to said shaft, said elongated member having a top side and a bottom side, said top side having a plurality of wells extending therein and aligned with each other along a line orientated parallel to said longitudinal axis, each of said wells corresponding to one of said selectable amounts;

a lever being attached to said shaft, said lever being selectively positionable in a first position rotating said elongated member such that said wells are directed toward said pour opening or in a second position rotating said elongated member such that said wells are directed toward said bottom wall;

a gear being rotatably mounted in said housing and having a rotational axis orientated perpendicular to said longitudinal axis, said gear being in communication with teeth on said top side of said elongated member when said lever is in said second position, said elongated member being slidably moved along said shaft when said gear is rotated; and a rod being attached to said gear and extending through said front wall, a handle being attached to a distal end of said rod with respect to said gear.

2. The apparatus according to claim 1, further including a lip extending upwardly from said back wall, said lip having a plurality of apertures extending therethrough configured for receiving a fastener.

3. The apparatus according to claim 1, wherein said selectable amounts consists of 1 cup, ¾ cup, ½ cup and ¼ cup.

4. The apparatus according to claim 1, further including a plurality of measurement indicia being positioned on said front wall adjacent to said handle and each corresponding to one of said selectable amounts, an indicator marking being positioned on said handle, wherein one of said wells is aligned with said pour opening when an associated one of said measurement indicia is indicated by said indicator marking.

5. The apparatus according to claim 1, further including a softener sheet compartment extending into said second side wall, said front wall having an elongated slot therein extending into said softener sheet compartment, wherein softener sheets positioned in said softener sheet compartment are selectively removed from said softener sheet compartment through said slot.

6. The apparatus according to claim 1, further including a container compartment extending into said first side wall and being positioned adjacent to said back wall.

7. A laundry soap dispensing apparatus for storing and dispensing selected quantities of laundry soap, said apparatus comprising:

a housing having a back wall, a bottom wall, a front wall, a first side wall and a second side wall, a cover being hingedly coupled to said back wall for selectively opening or closing an access opening defined by a top side of said housing, a lip extending upwardly from said back wall, said lip having a plurality of apertures extending therethrough configured for receiving a fastener, said front wall having a cup opening therein positioned adjacent to said bottom wall and configured for receiving a cup;

a trough being mounted within said housing, said trough having an upper end extending across said access opening, said trough having a pour opening therein directed toward said bottom wall and a cup extended through said cup opening, wherein any laundry soap poured into said access opening is directed into said trough and toward the pour opening, said trough having angled walls angling toward said pour opening;

a measuring assembly being mounted in said housing and being in fluid communication with said pour opening, said measuring assembly being configured to dispense one of a plurality of selectable amounts of laundry soap into the cup, said selectable amounts consisting of 1 cup, ¾ cup, ½ cup and ¼ cup, wherein laundry soap positioned within said trough may be poured into the cup by actuating said measuring assembly, said measuring assembly including:

a shaft being rotatably mounted in said housing and extending outwardly of said first side wall, said shaft being positioned between said pour opening and said cup opening;

an elongated member being slidably mounted on said shaft and having a longitudinal axis orientated perpendicular to said first side wall and parallel to said shaft, said elongated member having a top side and a bottom side, said top side having a plurality of wells extending therein and aligned with each other along a line orientated parallel to said longitudinal axis, each of said wells corresponding to one of said selectable amounts;

a lever being attached to said shaft, said lever being selectively positionable in a first position rotating said elongated member such that said wells are directed toward said pour opening or in a second position rotating said elongated member such that said wells are directed toward said bottom wall;

a gear being rotatably mounted in said housing and having a rotational axis orientated perpendicular to said longitudinal axis, said gear being in communication with teeth on said top side of said elongated member when said lever is in said second position, said elongated member being slidably moved along said shaft when said gear is rotated;

a rod being attached to said gear and extending through said front wall, a handle being attached to a distal end of said rod with respect to said gear;

a plurality of measurement indicia being positioned on said front wall adjacent to said handle and each corresponding to one of said selectable amounts, an indicator marking being positioned on said handle, wherein one of said wells is aligned with said pour opening when an associated one of said measurement indicia is indicated by said indicator marking;

a softener sheet compartment extending into said second side wall, said front wall having an elongated slot therein extending into said softener sheet compartment, wherein softener sheets positioned in said softener sheet compartment are selectively removed from said softener sheet compartment through said slot; and a container compartment extending into said first side wall and being positioned adjacent to said back wall.

* * * * *